US011852058B2

(12) United States Patent
Sugimoto et al.

(10) Patent No.: US 11,852,058 B2
(45) Date of Patent: Dec. 26, 2023

(54) SILENCING APPARATUS AND METHOD FOR MANUFACTURING SILENCING APPARATUS

(71) Applicant: SANKEI GIKEN KOGYO CO., LTD., Tokyo (JP)

(72) Inventors: Hidetoshi Sugimoto, Isesaki (JP); Kunitaka Yamauchi, Isesaki (JP)

(73) Assignee: SANKEI GIKEN KOGYO CO., LTD., Tokyo (JP)

( * ) Notice: Subject to any disclaimer, the term of this patent is extended or adjusted under 35 U.S.C. 154(b) by 213 days.

(21) Appl. No.: 17/435,564

(22) PCT Filed: Feb. 7, 2020

(86) PCT No.: PCT/JP2020/004996
§ 371 (c)(1),
(2) Date: Sep. 1, 2021

(87) PCT Pub. No.: WO2020/179363
PCT Pub. Date: Sep. 10, 2020

(65) Prior Publication Data

US 2022/0065144 A1 Mar. 3, 2022

(30) Foreign Application Priority Data

Mar. 6, 2019 (JP) ..... 2019-040318

(51) Int. Cl.
*F01N 1/04* (2006.01)
*G10K 11/162* (2006.01)

(52) U.S. Cl.
CPC ..... *F01N 1/04* (2013.01); *G10K 11/162* (2013.01); *F01N 2310/02* (2013.01); *F01N 2450/06* (2013.01)

(58) Field of Classification Search
CPC .... F01N 1/04; F01N 2310/02; F01N 2450/06; F01N 1/24
See application file for complete search history.

(56) References Cited

U.S. PATENT DOCUMENTS 4,569,471 A 2/1986 Ingemansson et al.
4,993,513 A 2/1991 Inoue et al.
(Continued)

FOREIGN PATENT DOCUMENTS

JP 58-198094 A 11/1983
JP 1-115832 U 8/1989
(Continued)

OTHER PUBLICATIONS

International Search Report dated Apr. 21, 2020, issued in counterpart application No. PCT/JP2020/004996 (2 pages).

*Primary Examiner* — Jeremy A Luks
(74) *Attorney, Agent, or Firm* — WHDA, LLP

(57) ABSTRACT

A silencing apparatus is provided with a shell, ventilation pipes communicating with the inside of the shell, insertion holes which are respectively formed in the shell so as to have sizes smaller than surrounding skirt parts and allow the ventilation pipes to be loosely inserted in, and partitions partitioning the inside of the shell. In the silencing apparatus, at least, a sound-absorbing chamber partitioned by the partition and positioned adjacent to the insertion hole is filled with a sound-absorbing fiber material, and a sound-absorbing fiber material filling gap between the insertion hole and the ventilation pipe is closed by an annular closing member. To provide a silencing apparatus allowing a sound-absorbing chamber to be filled with sound-absorbing fiber material without a gap, even in a complicated configuration having the inside of a shell partitioned by a partition.

13 Claims, 11 Drawing Sheets

(56) References Cited

U.S. PATENT DOCUMENTS 6,094,817 A * 8/2000 Shah ..... F01N 1/24 29/890.03
6,158,547 A * 12/2000 Ackermann ..... F01N 1/24 181/256
6,317,959 B1 * 11/2001 Nilsson ..... F16L 59/14 29/455.1
6,446,750 B1 * 9/2002 Lewin ..... F01N 1/24 181/258
6,467,571 B2 * 10/2002 Nakagawa ..... F01N 1/24 181/252
6,581,723 B2 * 6/2003 Brandt ..... F01N 1/04 181/252
6,607,052 B2 * 8/2003 Brandt ..... F01N 1/04 181/252
7,165,648 B2 * 1/2007 Arsdale ..... F01N 1/084 181/252
7,975,382 B2 * 7/2011 Brandt ..... F01N 1/04 29/455.1
8,590,155 B2 * 11/2013 Nilsson ..... B21D 51/16 181/256
8,813,362 B2 * 8/2014 Brandt ..... F01N 1/04 29/530
9,938,872 B2 * 4/2018 Wildgrube ..... F01N 1/082
2005/0001012 A1 1/2005 Brandt et al.
2008/0163488 A1 * 7/2008 Lecoester ..... F01N 1/003 29/890.08
2011/0031660 A1 2/2011 Huff et al.

FOREIGN PATENT DOCUMENTS

JP 2000-356119 A 12/2000
JP 2008-69766 A 3/2008
JP 2009-281369 A 12/2009
JP 2015-78631 A 4/2015

* cited by examiner

SILENCING APPARATUS AND METHOD FOR MANUFACTURING SILENCING APPARATUS

TECHNICAL FIELD

The present invention relates to a silencing apparatus to be installed in an exhaust path or the like of an automobile, and relates to a silencing apparatus with a sound-absorbing chamber filled with sound-absorbing fiber material and a method for manufacturing the silencing apparatus.

BACKGROUND ART

In the prior art, as a known silencing apparatus to be installed in an exhaust path of an automobile, a sound-absorbing chamber is filled with sound-absorbing fiber material such as glass wool. In one method of the filling with sound-absorbing fiber material, the sound-absorbing fiber material is packed into bag bodies, and the bag bodies filled with the sound-absorbing fiber material are arranged in the sound-absorbing chamber. In the method, variation in silencing effect may occur due to the gap formed between the bag bodies, and the cost of the bagging of the sound-absorbing fiber material is required. Accordingly, the filling method of directly filling a chamber serving as a sound-absorbing chamber with sound-absorbing fiber material is used.

The silencing apparatuses disclosed in Patent Documents 1, 2 are manufactured by the method of direct filling with sound-absorbing fiber material. Each of the silencing apparatuses disclosed in Patent Documents 1, 2 has an outer cylinder and a porous inner cylinder with pores penetrating the outer cylinder, and has a sound-absorbing chamber which is arranged between the inner cylinder and the outer cylinder and filled with sound-absorbing fiber material. The silencing apparatuses are manufactured by, under the state where one edge part of the outer cylinder is fixed to the inner cylinder and closed, filling the space between the inner cylinder and the outer cylinder with the sound-absorbing fiber material from the other opened edge part of the outer cylinder, and tapering and closing the other opened edge part of the outer cylinder after the filling, or closing the opening by arranging an end plate over the opening.

CITATION LIST

Patent Literature

[Patent Document 1] Japanese Patent Application Laid-Open Publication No. 2008-69766

[Patent Document 2] Japanese Patent Application Laid-Open Publication No. 2009-281369

SUMMARY OF INVENTION

Technical Problem

Although the direct filling method disclosed in Patent Documents 1, 2 is applicable to a simple configuration in which the space between a porous inner cylinder and an outer cylinder is filled with sound-absorbing fiber material, the method is hardly applied to a silencing apparatus in a complicated configuration having the inside of a shell partitioned into plural sections by a partition. Therefore, a silencing apparatus is required, which allows, even in a complicated configuration having the inside of a shell partitioned by a partition, a sound-absorbing chamber to be filled with sound-absorbing fiber material without a gap.

The present invention is proposed by taking the above problem into consideration, to provide a silencing apparatus which allows, even in a complicated configuration having the inside of a shell partitioned by a partition, a sound-absorbing chamber to be filled with sound-absorbing fiber material without a gap, and a method for manufacturing the silencing apparatus.

Solution to Problem

The silencing apparatus according to the present invention includes a shell, a ventilation pipe communicating with the inside of the shell, an insertion hole which is formed in the shell so as to have a size smaller than a surrounding skirt part and allows the ventilation pipe to be loosely inserted in, and a partition partitioning the inside of the shell. In the silencing apparatus, a sound-absorbing chamber partitioned by the partition and positioned adjacent to the insertion hole is filled with a sound-absorbing fiber material, and a sound-absorbing fiber material filling gap between a peripheral edge of the insertion hole and the ventilation pipe is closed by an annular closing member.

The silencing apparatus allows to fill the sound-absorbing chamber partitioned by the partition and positioned adjacent to the insertion hole with the sound-absorbing fiber material through the sound-absorbing fiber material filling gap, thereby enabling to fill the sound-absorbing chamber with the sound-absorbing fiber material without a gap even in a complicated configuration having the inside of the shell partitioned by the partition. Therefore, this enables to prevent and suppress the variation in silencing effect from occurring. Moreover, such direct filling with the sound-absorbing fiber material through the sound-absorbing fiber material filling gap eliminates the cost and work of bagging of the sound-absorbing fiber material, resulting in reducing the manufacturing costs and improving the efficiency in manufacturing.

The silencing apparatus according to the present invention includes a first ventilation pipe and a second ventilation pipe communicating with the inside of the shell, a first insertion hole which is formed in the shell so as to have a size smaller than a surrounding skirt part and allows the first ventilation pipe to be loosely inserted in, and a second insertion hole which is formed in the shell so as to have a size smaller than a surrounding skirt part and allows the second ventilation pipe to be loosely inserted in. In the silencing apparatus, at least, a first sound-absorbing chamber partitioned by a first partition and positioned adjacent to the first insertion hole is filled with the sound-absorbing fiber material, and a first sound-absorbing fiber material filling gap between a peripheral edge of the first insertion hole and the first ventilation pipe is closed by a first annular closing member.

Accordingly, the silencing apparatus may have the first sound-absorbing chamber filled with the sound-absorbing fiber material, or the silencing apparatus may have a chamber partitioned by the second partition and positioned adjacent to the second insertion hole to be filled with the sound-absorbing fiber material as necessary so as to additionally serve as the second sound-absorbing chamber, resulting in that the silencing apparatus is available in various configurations having the same basic configuration differed in the number of sound-absorbing chambers. In an example, a silencing apparatus for an automobile with a turbocharger may be provided with only the first sound-absorbing chamber, and a silencing apparatus for a hybrid automobile may be provided with the first sound-absorbing chamber and the second sound-absorbing chamber. From the viewpoint of commonization of the basic configuration of the silencing apparatus, the manufacturing costs are reduced, and the efficiency in manufacturing is improved.

In the silencing apparatus according to the present invention, a second sound-absorbing chamber partitioned by a second partition and positioned adjacent to the second insertion hole is filled with the sound-absorbing fiber material, and a second sound-absorbing fiber material filling gap between a peripheral edge of the second insertion hole and the second ventilation pipe is closed by a second annular closing member.

Accordingly, the arrangement of the first sound-absorbing chamber and the second sound-absorbing chamber filled with the sound-absorbing fiber material enables to produce higher silencing performance in the silencing apparatus.

In the silencing apparatus according to the present invention, the partition is formed in a plate shape, and the plate-shape partition has a large number of communication holes not allowing the sound-absorbing fiber material to pass through, substantially over the whole surface.

This enables to implement the filling with the sound-absorbing fiber material through the sound-absorbing fiber material filling gap by using a negative pressure in the adjacent chamber which is partitioned by the partition and positioned adjacent to the chamber to be filled with the sound-absorbing fiber material and is made negative in pressure, regardless of the opening location and opening position of the ventilation pipe in the inside of the shell, thereby enabling to fill the sound-absorbing chamber with the sound-absorbing fiber material without a gap in a higher level with less variation in density. Accordingly, the variation in silencing effect is reliably prevented and suppressed from occurring.

In the silencing apparatus according to the present invention, the insertion hole is formed in a shape without any outward protrusion, and the annular closing member is arranged so as to cover the insertion hole.

In the silencing apparatus, the insertion hole has a shape without any outward protrusion formed by burring or the like, and this enhances the flexibility of the shape and configuration of a filling nozzle for use in the filling with the sound-absorbing fiber material, improves the flexibility in the manufacturing steps, and improves the productivity. This further enhances the flexibility of the operation and enlarges the range in the operation of the filling nozzle for use in the filling with the sound-absorbing fiber material, thereby enabling to fill the sound-absorbing chamber with the sound-absorbing fiber material without a gap in a higher level.

In the silencing apparatus according to the present invention, a connection pipe to be connected to the ventilation pipe is internally fitted to the peripheral edge of the insertion hole, and the annular closing member fitted in an inner circumference of the connection pipe is externally fitted to the ventilation pipe.

The usage of the annular closing member fitted in the inner circumference of the connection pipe for closing the sound-absorbing fiber material filling gap eliminates the needs of preparing and fixing an extra annular closing member in addition to the connection pipe. This reduces the component costs and the manufacturing costs, and reduces the manufacturing steps.

The method for manufacturing a silencing apparatus according to the present invention is to manufacture the silencing apparatus according to the present invention, and includes, under the state where an adjacent chamber positioned adjacent to a sound-absorbing corresponding chamber serving as the sound-absorbing chamber via the partition is made negative in pressure, a filling step of filling the sound-absorbing corresponding chamber with the sound-absorbing fiber material from a filling nozzle inserted in the sound-absorbing fiber material filling gap, and a closing step of closing the sound-absorbing fiber material filling gap with the annular closing member after the filling with the sound-absorbing fiber material.

The method enables to fill the sound-absorbing chamber with the sound-absorbing fiber material without a gap in a higher level with less variation in density by using the negative pressure in the adjacent chamber, thereby enabling to reliably prevent and suppress the variation in silencing effect from occurring in the manufactured silencing apparatus. The method enables to, after the filling with the sound-absorbing fiber material, easily close the sound-absorbing fiber material filling gap with the annular closing member, resulting in achieving efficient manufacturing.

The method for manufacturing a silencing apparatus according to the present invention is to manufacture the silencing apparatus according to the present invention including the first partition and the second partition respectively formed in plate shapes and respectively provided with large numbers of communication holes not allowing the sound-absorbing fiber material to pass through substantially over whole surfaces. The method includes the steps of, under the state where an expansion chamber positioned adjacent to a first sound-absorbing corresponding chamber serving as the first sound-absorbing chamber via the first partition is made negative in pressure by air suction through the second ventilation pipe, filling the first sound-absorbing corresponding chamber with the sound-absorbing fiber material from a filling nozzle inserted in the first sound-absorbing fiber material filling gap, and closing the first sound-absorbing fiber material filling gap with the first annular closing member after the filling, and the steps of, under the state where the expansion chamber positioned adjacent to a second sound-absorbing corresponding chamber serving as the second sound-absorbing chamber via the first partition is made negative in pressure by air suction through the first ventilation pipe, filling the second sound-absorbing corresponding chamber with the sound-absorbing fiber material from a filling nozzle inserted in the second sound-absorbing fiber material filling gap, and closing the second sound-absorbing fiber material filling gap with the second annular closing member after the filling.

The method enables to fill the first sound-absorbing chamber and the second sound-absorbing chamber with the sound-absorbing fiber material by using the negative pressure in the same expansion chamber. Moreover, in the filling of the first sound-absorbing corresponding chamber with the sound-absorbing fiber material, air is sucked through the second ventilation pipe, while in the filling of the second sound-absorbing corresponding chamber with the sound-absorbing fiber material, air is sucked through the first ventilation pipe, so that the first sound-absorbing chamber and the second sound-absorbing chamber are able to be filled with the sound-absorbing fiber material also by using the suction force. Thus, the first sound-absorbing chamber and the second sound-absorbing chamber are able to be filled with the sound-absorbing fiber material without a gap in a higher level with less variation in density in a reliable manner. Accordingly, the variation in the silencing effect in the manufactured silencing apparatus is more reliably prevented and suppressed from occurring. After the filling with the sound-absorbing fiber material, the first and second sound-absorbing fiber material filling gaps are able to be easily closed by the first and second annular closing members, respectively, resulting in achieving efficient manufacturing.

Advantageous Effects of Invention

The silencing apparatus according to the present invention has the effect allowing to fill a sound-absorbing chamber with sound-absorbing fiber material without a gap, even in a complicated configuration having the inside of a shell partitioned by a partition.

DESCRIPTION OF EMBODIMENTS

Silencing Apparatus of First Embodiment

Figure 1:
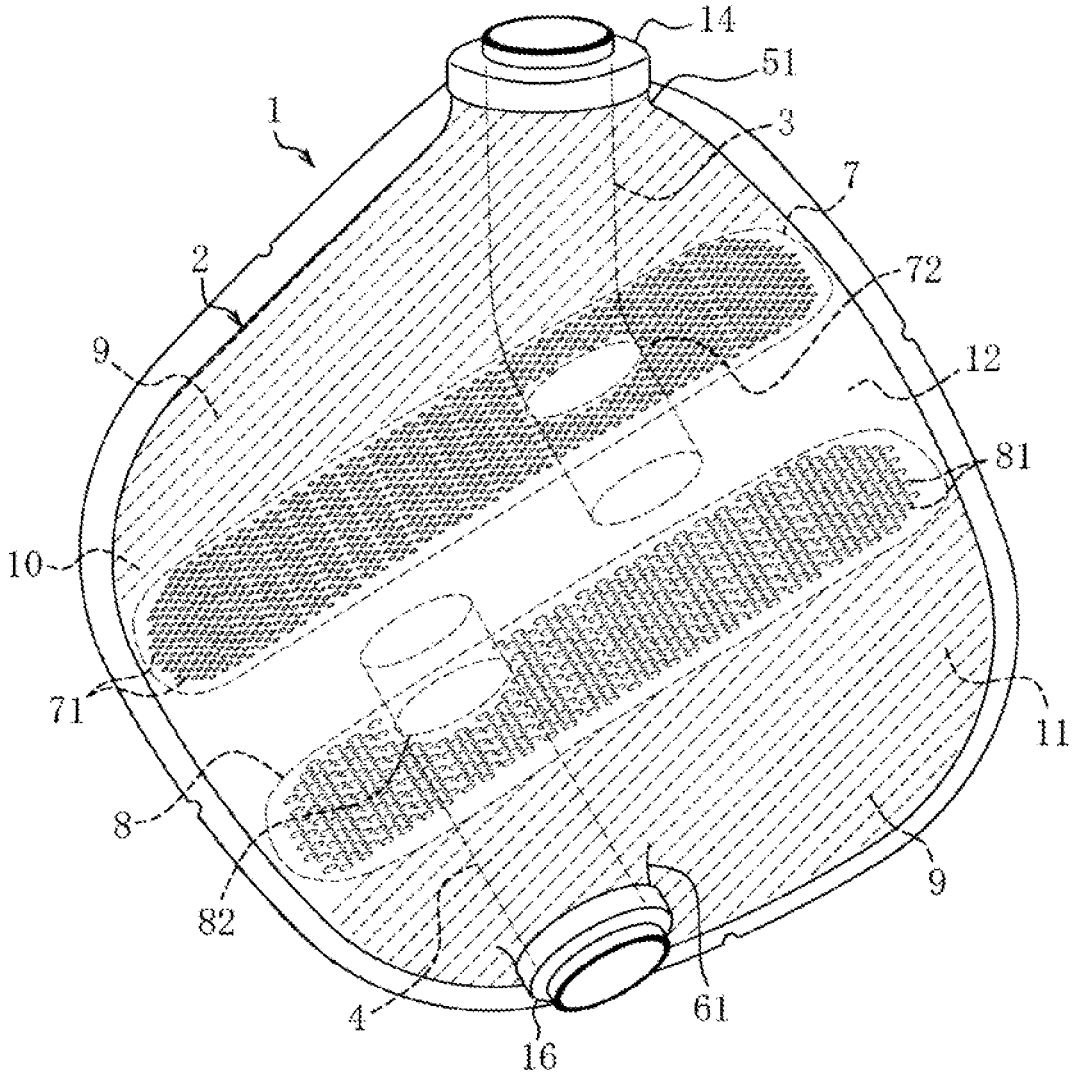
FIG. 1 is an oblique view illustrating a silencing apparatus of a first embodiment according to the present invention.

A silencing apparatus 1 of the first embodiment according to the present invention is configured to be installed in an exhaust path of an automobile, and includes, as shown in FIG. 1 to FIG. 4, a metal shell 2 formed substantially in a shell shape, ventilation pipes 3, 4 which respectively communicate with the inside of the shell 2 substantially at opposite positions of the shell 2, insertion holes 5, 6 respectively in which the ventilation pipes 3, 4 are inserted loosely, and partitions 7, 8 which partition the inside of the shell 2.

Each of the ventilation pipes 3, 4 is included in an exhaust pipe. The illustrated ventilation pipe 3 serves as an exhaust inlet pipe, and the ventilation pipe 4 serves as an exhaust outlet pipe. The ventilation pipe 3 is included in a first ventilation pipe which communicates with the inside of the shell 2, and the ventilation pipe 4 is included in a second ventilation pipe which communicates with the inside of the shell 2.

The insertion holes 5, 6 in which the ventilation pipes 3, 4 are loosely inserted are the through holes formed in the shell 2 so as to have sizes larger than the diameters of the ventilation pipes 3, 4, respectively. The insertion hole 5 is included in a first insertion hole in which the first ventilation pipe is inserted loosely, and is formed so as to have a size smaller than a surrounding skirt part 51 configured with the shell 2, and further so as to be opened at the tip part of a rising part 52 formed by burring or the like. The insertion hole 6 is included in a second insertion hole in which the second ventilation pipe is inserted loosely, and is formed so as to have a size smaller than a surrounding skirt part 61 configured with the shell 2, and further so as to be opened at the tip part of a rising part 62 formed by burring or the like.

The partitions 7, 8 are respectively formed in flat-plate shapes. The flat-plate-shape partitions 7, 8 respectively have large numbers of communication holes 71, 81 which are arranged in lines substantially over the whole surfaces thereof and do not allow a sound-absorbing fiber material 9 to be described later to pass therethrough. Each of the communication holes 71, 81 may have any diameter, as long as the diameter does not allow the sound-absorbing fiber material 9 to pass through the hole, and is preferably, for example, approx. 2 mm to 5 mm. The partition 7 is included in a first partition, and the partition 8 is included in a second partition.

The internal space of the shell 2 which is partitioned by the partition 7 corresponding to the first partition and positioned adjacent to the insertion hole 5 corresponding to the first insertion hole serves as a sound-absorbing chamber 10 corresponding to a first sound-absorbing chamber. The sound-absorbing chamber 10 is filled with the sound-absorbing fiber material 9. The internal space of the shell 2 which is partitioned by the partition 8 corresponding to the second partition and is positioned adjacent to the insertion hole 6 corresponding to the second insertion hole serves as a sound-absorbing chamber 11 corresponding to a second sound-absorbing chamber. The sound-absorbing chamber 11 is also filled with the sound-absorbing fiber material 9. It is noted that appropriate fiber material having a sound-absorbing function, such as glass wool, is available as the sound-absorbing fiber material 9 to be filled.

The internal space of the shell 2 between the partition 7 corresponding to the first partition and the partition 8 corresponding to the second partition serves as an expansion chamber 12. The ventilation pipe 3 is arranged in the internal space of the shell 2 so as to be opened in the expansion chamber 12 by being inserted through an insertion hole 72 formed in the partition 7. The ventilation pipe 4 is arranged in the internal space of the shell 2 so as to be opened in the expansion chamber 12 by being inserted through an insertion hole 82 formed in the partition 8.

Between the peripheral edge of the insertion hole 5 corresponding to the first insertion hole and the ventilation pipe 3 corresponding to the first ventilation pipe, a sound-absorbing fiber material filling gap 13 corresponding to a first sound-absorbing fiber material filling gap is provided so as to allow a filling nozzle 100 to be inserted therein to fill the sound-absorbing chamber 10 corresponding to the first sound-absorbing chamber with the sound-absorbing fiber material 9. The sound-absorbing fiber material filling gap 13 is closed by an annular closing member 14 corresponding to a first annular closing member (refer to FIG. 3).

Figure 2A:
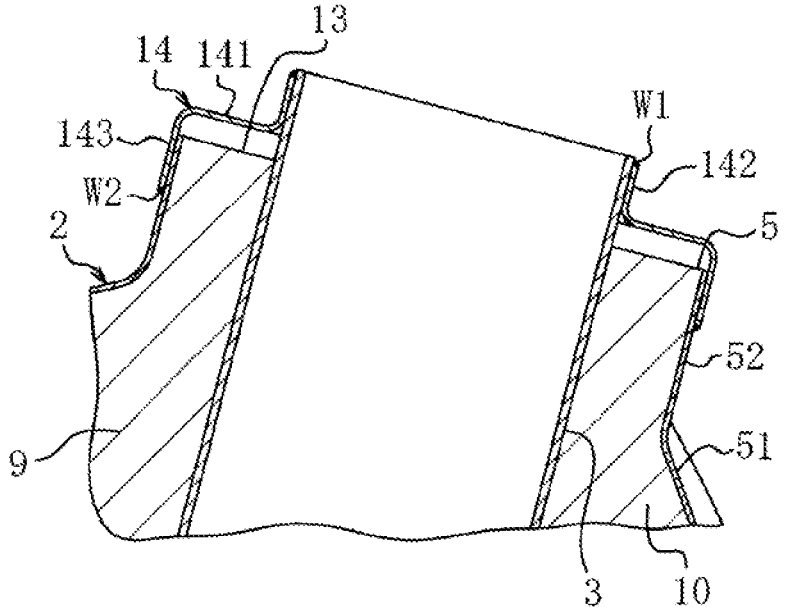
FIG. 2*a* is an enlarged cross-sectional view of a peripheral part of a first annular closing member in the silencing apparatus of the first embodiment.

As shown in FIG. 2*a*, the annular closing member 14 is formed of metal material such as stainless steel, in the cap-like shape in which an inner cylinder part 142 rises from the inner edge of an annular base plate 141, and an outer cylinder part 143 rises from the outer edge of the base plate 141 to the opposite side of the inner cylinder part 142. The inner cylinder part 142 of the annular closing member 14 is arranged along the outer circumference of the ventilation pipe 3, and is firmly fixed to the ventilation pipe 3 by welding at a welding part W1 such as the tip part of the inner cylinder part 142. The outer cylinder part 143 of the annular closing member 14 is arranged along the outer circumference of the rising part 52 of the shell 2, and is firmly fixed to the rising part 52 or the shell 2 by welding at a welding part W2 such as the tip part of the outer cylinder part 143.

Between the peripheral edge of the insertion hole 6 corresponding to the second insertion hole and the ventilation pipe 4 corresponding to the second ventilation pipe, a sound-absorbing fiber material filling gap 15 corresponding to a second sound-absorbing fiber material filling gap is provided so as to allow the filling nozzle 100 to be inserted therein to fill the sound-absorbing chamber 11 corresponding to the second sound-absorbing chamber with the sound-absorbing fiber material 9. The sound-absorbing fiber material filling gap 15 is closed by an annular closing member 16 corresponding to a second annular closing member (refer to FIG. 4).

Figure 2B:
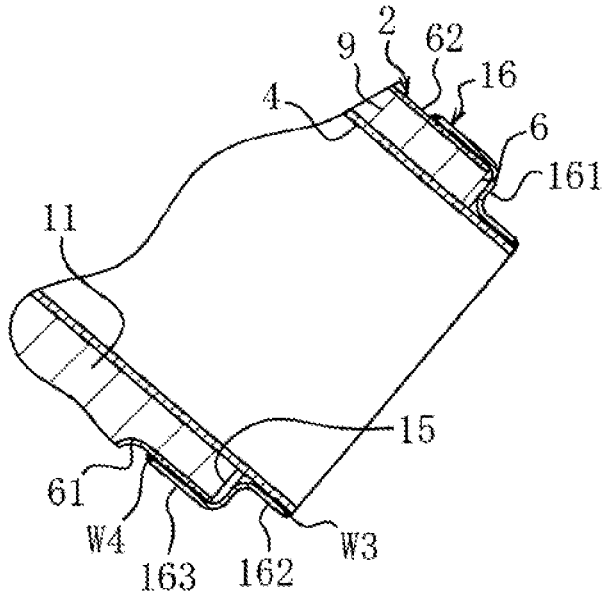
FIG. 2*b* is an enlarged cross-sectional view of a peripheral part of a second annular closing member in the silencing apparatus of the first embodiment.

As shown in FIG. 2*b*, the annular closing member 16 is formed of metal material such as stainless steel, in the cap-like shape in which an inner cylinder part 162 rises from the inner edge of an annular base plate 161, and an outer cylinder part 163 rises from the outer edge of the base plate 161 to the opposite side of the inner cylinder part 162. The base plate 161 of the annular closing member 16 is formed in a size smaller than the base plate 141 so as to correspond to the size of the sound-absorbing fiber material filling gap 15 formed narrower than the sound-absorbing fiber material filling gap 13. The inner cylinder part 162 of the annular closing member 16 is arranged along the outer circumference of the ventilation pipe 4, and is firmly fixed to the ventilation pipe 4 by welding at a welding part W3 such as the tip part of the inner cylinder part 162. The outer cylinder part 163 of the annular closing member 16 is arranged along the outer circumference of the rising part 62 of the shell 2, and is firmly fixed to the rising part 62 or the shell 2 by welding at a welding part W4 such as the tip part of the outer cylinder part 163.

Figure 3A:
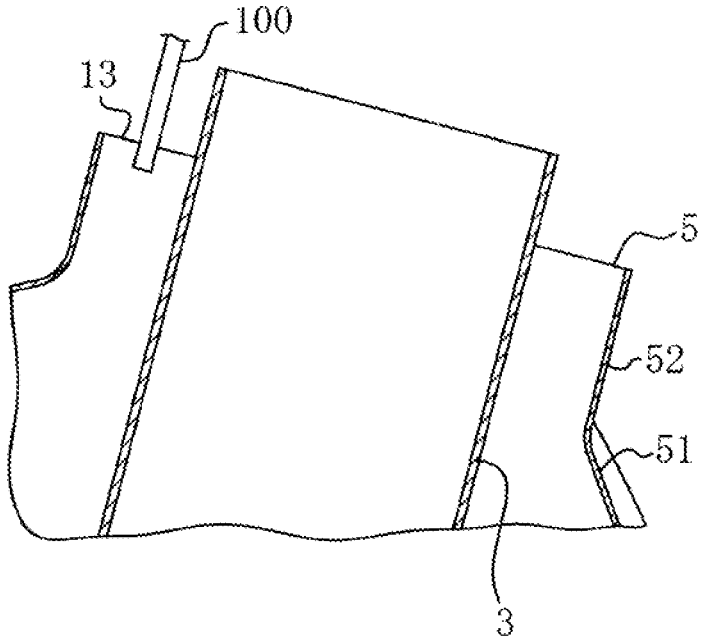
FIG. 3*a* is a partial cross-sectional explanatory drawing for describing filling with sound-absorbing fiber material through a first sound-absorbing fiber material filling gap in the silencing apparatus of the first embodiment.

In the manufacturing of the silencing apparatus 1 of the first embodiment, as shown in FIG. 3*a*, a first sound-absorbing corresponding chamber serving as the sound-absorbing chamber 10 corresponding to the first sound-absorbing chamber is filled with the sound-absorbing fiber material 9 from the filling nozzle 100 inserted in the sound-absorbing fiber material filling gap 13 arranged between the insertion hole 5 and the ventilation pipe 3. In the filling step, the filling with the sound-absorbing fiber material 9 is preferably implemented under the state where the adjacent expansion chamber 12 positioned adjacent to the first sound-absorbing corresponding chamber via the partition 7 is made negative in pressure. In particular, the filling with the sound-absorbing fiber material 9 is more preferably implemented under the state where the adjacent expansion chamber 12 is made negative in pressure by air suction through the ventilation pipe 4 corresponding to the second ventilation pipe. It is noted that the filling with the sound-absorbing fiber material 9 may be implemented by sending air through the ventilation pipe 3 corresponding to the first ventilation pipe.

Figure 3B:
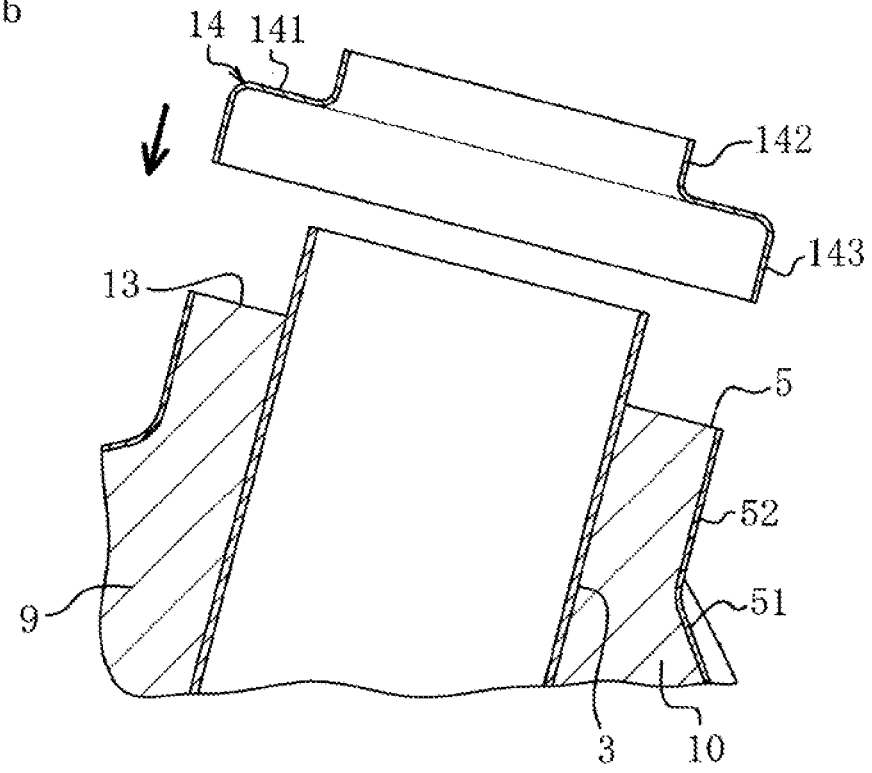
FIG. 3*b* is a partial cross-sectional explanatory drawing for describing closing of the first sound-absorbing fiber material filling gap with the first annular closing member.

As shown in FIG. 3*b* and FIG. 2*a*, after the sound-absorbing chamber 10 is configured by the filling with the sound-absorbing fiber material 9, the filling nozzle 100 is removed from the sound-absorbing fiber material filling gap 13, and the annular closing member 14 is arranged so that the sound-absorbing fiber material filling gap 13 is covered and that the inner cylinder part 142 and the outer cylinder part 143 respectively fit to the ventilation pipe 3 and the rising part 52 (refer to the thick line arrow in FIG. 3*b*). The annular closing member 14 is then firmly fixed by welding at the welding parts W1, W2, whereby the sound-absorbing fiber material filling gap 13 is closed by the annular closing member 14.

Figure 4A:
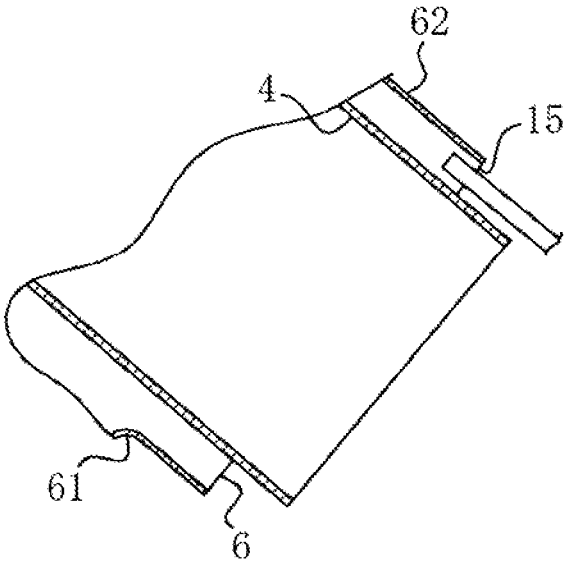
FIG. 4*a* is a partial cross-sectional explanatory drawing for describing filling with the sound-absorbing fiber material through a second sound-absorbing fiber material filling gap in the silencing apparatus of the first embodiment.

As shown in FIG. 4*a*, a second sound-absorbing corresponding chamber serving as the sound-absorbing chamber 11 corresponding to the second sound-absorbing chamber is also filled with the sound-absorbing fiber material 9 from the filling nozzle 100 inserted in the sound-absorbing fiber material filling gap 15 arranged between the insertion hole 6 and the ventilation pipe 4. In the filling step, the filling with the sound-absorbing fiber material 9 is preferably implemented under the state where the adjacent expansion chamber 12 positioned adjacent to the second sound-absorbing corresponding chamber via the partition 8 is made negative in pressure. In particular, the filling with the sound-absorbing fiber material 9 is more preferably implemented under the state where the adjacent expansion chamber 12 is made negative in pressure by air suction through the ventilation pipe 3 corresponding to the first ventilation pipe. It is noted that the filling with the sound-absorbing fiber material 9 may be implemented by sending air through the ventilation pipe 4 corresponding to the second ventilation pipe.

Figure 4B:
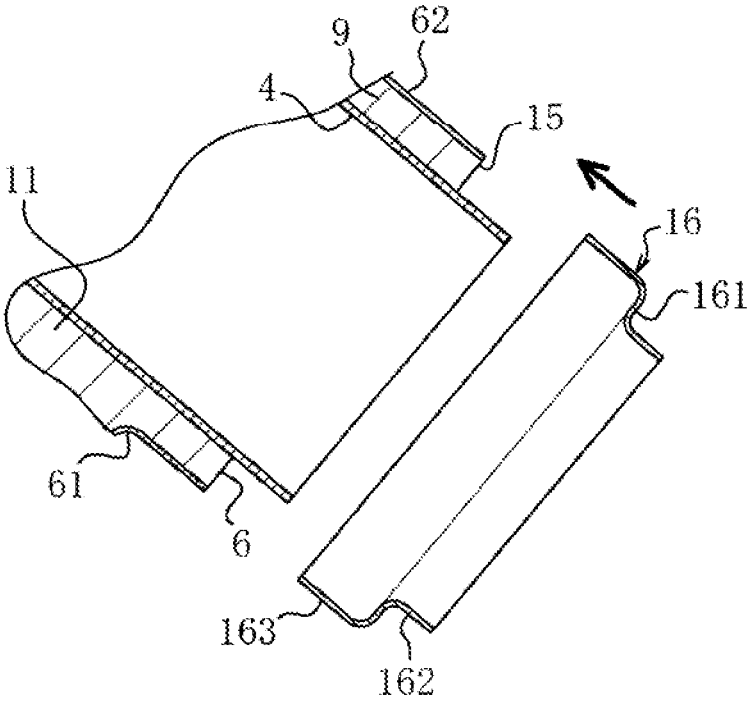
FIG. 4*b* is a partial cross-sectional explanatory drawing for describing closing of the second sound-absorbing fiber material filling gap with the second annular closing member.
Figure 5:
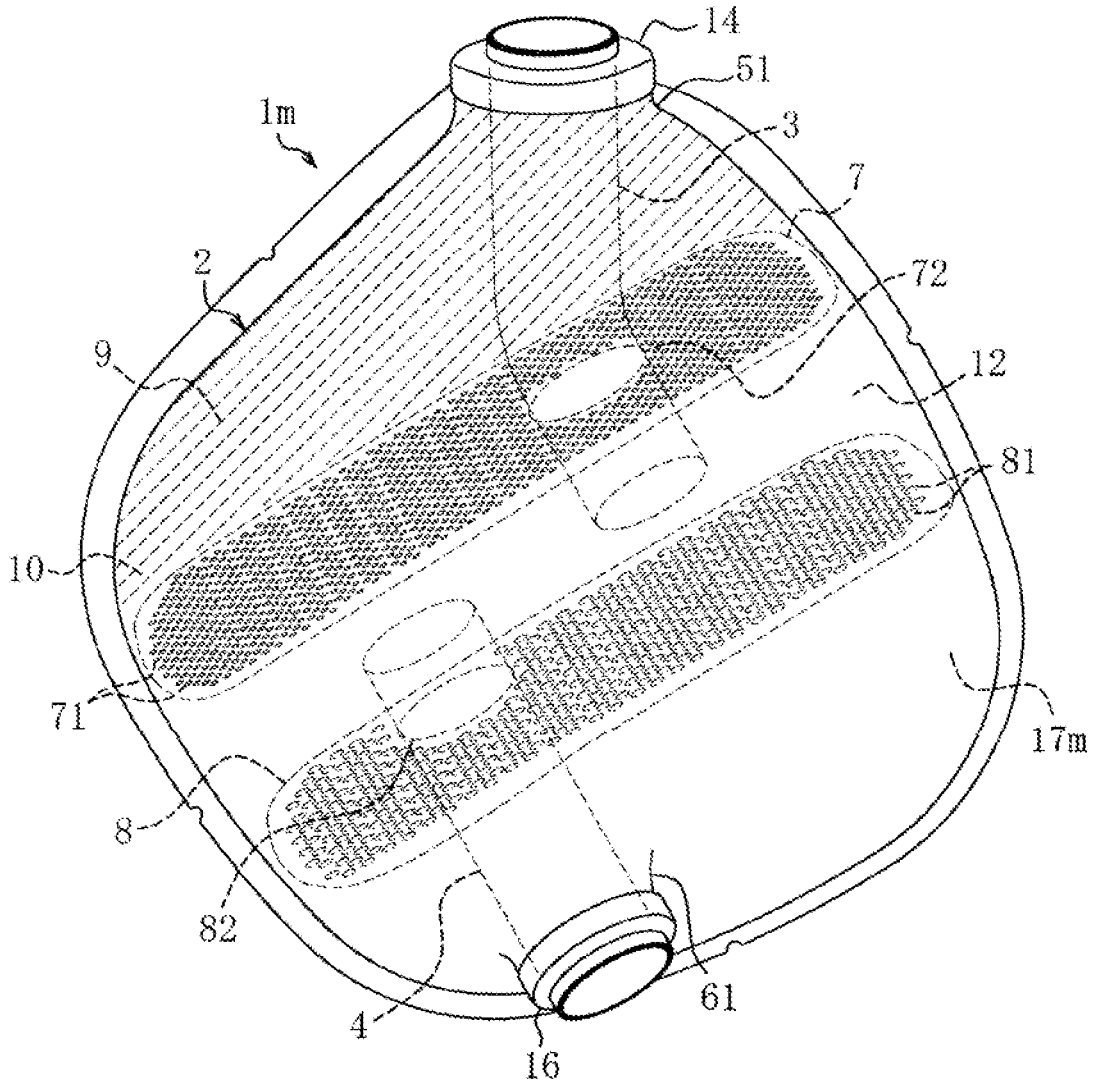
FIG. 5 is an oblique view illustrating a modification of the silencing apparatus of the first embodiment according to the present invention.

As shown in FIG. 4*b* and FIG. 2*b*, after the sound-absorbing chamber 11 is configured by the filling with the sound-absorbing fiber material 9, the filling nozzle 100 is removed from the sound-absorbing fiber material filling gap 15, and the annular closing member 16 is arranged so that the sound-absorbing fiber material filling gap 15 is covered and that the inner cylinder part 162 and the outer cylinder part 163 respectively fit to the ventilation pipe 4 and the rising part 62 (refer to the thick line arrow in FIG. 4*b*). The annular closing member 16 is then firmly fixed by welding at the welding parts W3, W4, whereby the sound-absorbing fiber material filling gap 15 is closed by the annular closing member 16.

According to the first embodiment, the sound-absorbing chambers 10, 11 which are partitioned by the partitions 7, 8 and positioned adjacent to the insertion holes 5, 6, respectively, are able to be filled with the sound-absorbing fiber material 9 through the sound-absorbing fiber material filling gaps 13, 15, whereby the sound-absorbing chambers 10, 11 are able to be filled with the sound-absorbing fiber material 9 without a gap, even in the case of the complicated configuration in which the inside of the shell 2 is partitioned by the partitions 7, 8. Therefore, this enables to prevent and suppress the variation in silencing effect from occurring. Moreover, such direct filling with the sound-absorbing fiber material 9 through the sound-absorbing fiber material filling gaps 13, 15 eliminates the cost and work of bagging of the sound-absorbing fiber material, resulting in reducing the manufacturing costs and improving the efficiency in manufacturing. The arrangement of the first sound-absorbing chamber and the second sound-absorbing chamber filled with the sound-absorbing fiber material enables to produce higher silencing performance in the silencing apparatus.

The flat-plate-shape partitions 7, 8 respectively have large numbers of communication holes 71, 81 which are arranged substantially over the whole surfaces thereof and do not allow the sound-absorbing fiber material 9 to pass therethrough, and this enables to implement the filling with the sound-absorbing fiber material 9 through the sound-absorbing fiber material filling gaps 13, 15 by using the negative pressure in the adjacent chamber which is partitioned by the partitions 7, 8 and positioned adjacent to the chambers to be filled with the sound-absorbing fiber material 9 and is made negative in pressure, regardless of the opening locations and opening positions of the ventilation pipes 3, 4 in the inside of the shell 2. This enables to fill the sound-absorbing chambers 10, 11 with the sound-absorbing fiber material 9 without a gap in a higher level with less variation in density. Accordingly, the variation in silencing effect is reliably prevented and suppressed from occurring.

In the manufacturing method including the filling with the sound-absorbing fiber material 9 under the state of the chamber positioned adjacent to the sound-absorbing corresponding chambers and made negative in pressure, the sound-absorbing chambers 10, 11 are able to be filled with the sound-absorbing fiber material 9 by using the negative pressure in the adjacent chamber without a gap in a higher level with less variation in density, thereby enabling to reliably prevent and suppress the variation in silencing effect from occurring in the manufactured silencing apparatus 1. After the filling with the sound-absorbing fiber material 9, the sound-absorbing fiber material filling gaps 13, 15 are able to be easily closed by the annular closing members 14, 16, resulting in achieving efficient manufacturing.

The sound-absorbing chambers 10, 11 are further able to be filled with the sound-absorbing fiber material 9 by using the negative pressure in the same expansion chamber 12. Moreover, in the filling of the first sound-absorbing corresponding chamber with the sound-absorbing fiber material 9, air is sucked through the ventilation pipe 4, while in the filling of the second sound-absorbing corresponding chamber with the sound-absorbing fiber material 9, air is sucked through the ventilation pipe 3, whereby the sound-absorbing chambers 10, 11 are able to be filled with the sound-absorbing fiber material 9 also by using the suction force without a gap in a higher level with less variation in density in a reliable manner. Accordingly, the variation in silencing effect in the manufactured silencing apparatus 1 is more reliably prevented and suppressed from occurring. After the filling with the sound-absorbing fiber material 9, the sound-absorbing fiber material filling gaps 13, 15 are able to be easily closed by the annular closing members 14, 16, respectively, resulting in achieving efficient manufacturing.

Modified Silencing Apparatus of First Embodiment

A silencing apparatus 1*m* of a modification of the first embodiment according to the present invention has the same basic configuration as the silencing apparatus 1 of the first embodiment. The chamber corresponding to the sound-absorbing chamber 11 of the silencing apparatus 1 is not filled with the sound-absorbing fiber material 9, and the chamber serves as an expansion chamber 17*m*. The manufacturing of the silencing apparatus 1*m* includes similar steps to the steps of configuring the sound-absorbing chamber 10 for the silencing apparatus 1 of the first embodiment, and further includes the step of closing the sound-absorbing fiber material filling gap 15 with the annular closing member 16 without filling the chamber serving as the expansion chamber 17*m* with the sound-absorbing fiber material 9. Other configurations of the silencing apparatus 1*m* and the method for manufacturing the silencing apparatus 1*m* are the same as the configurations of the silencing apparatus 1 and the method for manufacturing the silencing apparatus 1 in the first embodiment.

According to the silencing apparatus 1 of the first embodiment and the silencing apparatus 1*m* of the modification, the silencing apparatus may have the first sound-absorbing chamber filled with the sound-absorbing fiber material 9, or the silencing apparatus may additionally have the second sound-absorbing chamber to be filled with the sound-absorbing fiber material 9 as necessary, resulting in that the silencing apparatus is available in various configurations having the same basic configuration differed in the number of sound-absorbing chambers. In an example, a silencing apparatus for an automobile with a turbocharger may be provided with only the first sound-absorbing chamber, and a silencing apparatus for a hybrid automobile may be provided with the first sound-absorbing chamber and the second sound-absorbing chamber. From the viewpoint of commonization of the basic configuration of the silencing apparatus, the manufacturing costs are reduced, and the efficiency in manufacturing is improved.

Silencing Apparatus of Second Embodiment

Figure 6:
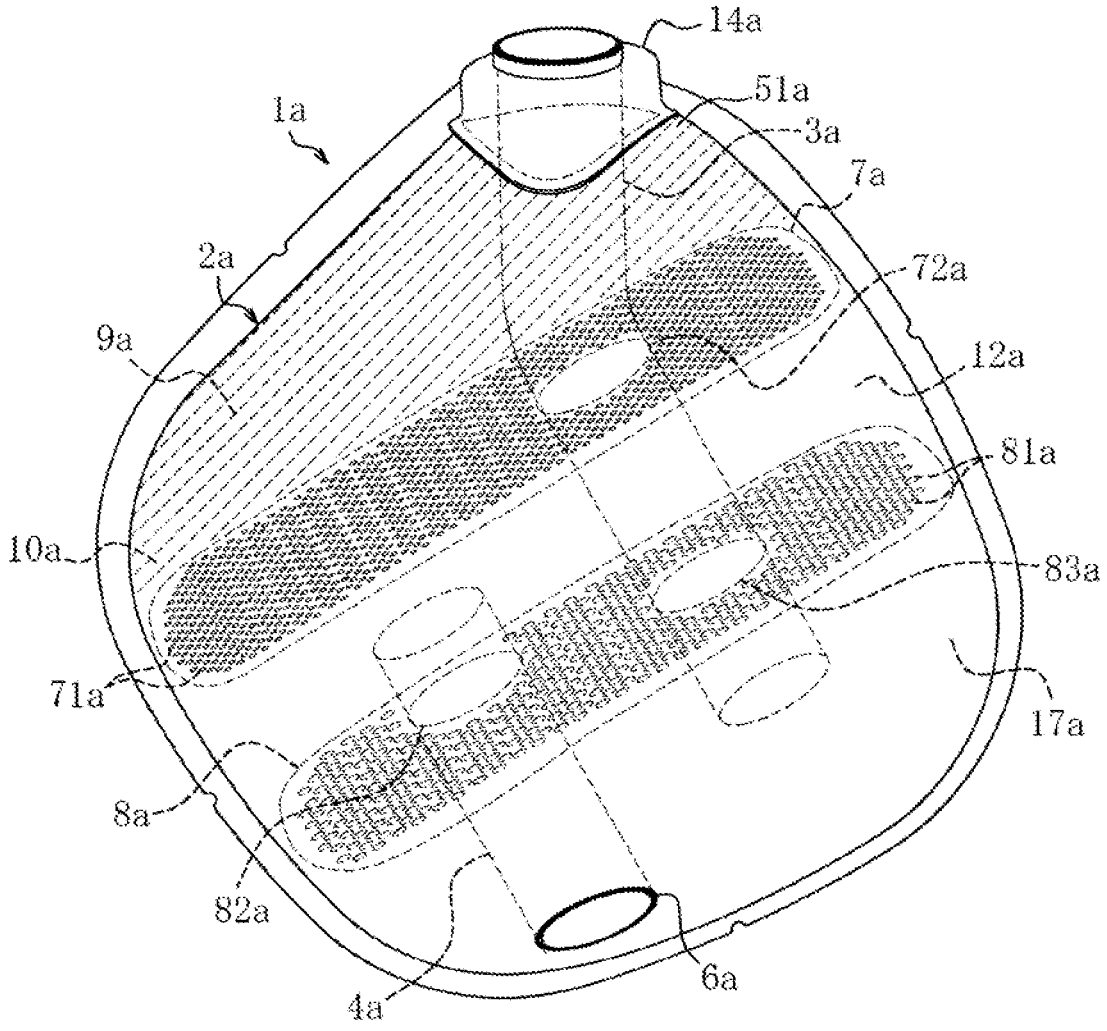
FIG. 6 is an oblique view illustrating a silencing apparatus of a second embodiment according to the present invention.
Figure 7:
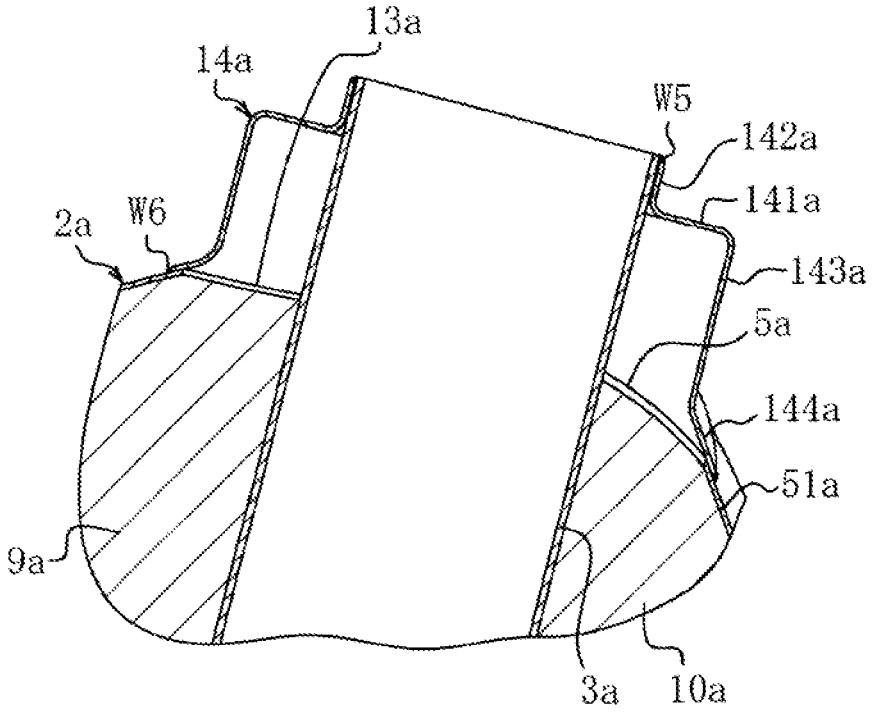
FIG. 7 is an enlarged cross-sectional view of a peripheral part of an annular closing member in the silencing apparatus of the second embodiment.

A silencing apparatus 1*a* of the second embodiment according to the present invention is also configured to be installed in an exhaust path of an automobile, and includes, as shown in FIG. 6 to FIG. 8, a metal shell 2*a* formed substantially in a shell shape, ventilation pipes 3*a*, 4*a* which respectively communicate with the inside of the shell 2*a* substantially at opposite positions of the shell 2*a*, an insertion hole 5*a* in which the ventilation pipe 3*a* is inserted loosely, an insertion hole 6*a* in which the ventilation pipe 4*a* is inserted, and partitions 7*a*, 8*a* which partition the inside of the shell 2*a*.

Each of the ventilation pipes 3*a*, 4*a* is included in an exhaust pipe. The illustrated ventilation pipe 3*a* serves as an exhaust inlet pipe, and the ventilation pipe 4*a* serves as an exhaust outlet pipe. The insertion holes 5*a*, 6*a* in which the ventilation pipes 3*a*, 4*a* are loosely inserted are the through holes formed in the shell 2*a* so as to have sizes larger than the diameters of the ventilation pipes 3*a*, 4*a*, respectively. The insertion hole 5*a* is formed so as to have a size allowing the ventilation pipe 3*a* to be loosely inserted in, and the insertion hole 6*a* is formed so as to have a size allowing the ventilation pipe 4*a* to fit in. The ventilation pipe 4*a* is firmly fixed to the peripheral edge of the insertion hole 6*a* by welding or the like. The insertion hole 5*a* is formed so as to have a size smaller than a surrounding skirt part 51*a* configured with the shell 2*a*, in a shape without any outward protrusion.

The partitions 7*a*, 8*a* are respectively formed in flat-plate shapes. The flat-plate-shape partitions 7*a*, 8*a* respectively have communication holes 71*a*, 81*a* which have the same configurations as the communication holes 71, 81 of the first embodiment. The internal space of the shell 2*a* which is partitioned by the partition 7*a* and is positioned adjacent to the insertion hole 5*a* serves as a sound-absorbing chamber 10*a*. The sound-absorbing chamber 10*a* is filled with a sound-absorbing fiber material 9*a* which has the same configuration as the sound-absorbing fiber material 9 of the first embodiment.

The internal space of the shell 2*a* between the partition 7*a* and the partition 8*a* serves as an expansion chamber 12*a*. In addition, the internal space of the shell 2*a* which is partitioned by the partition 8*a* and is positioned adjacent to the insertion hole 6*a* serves as an expansion chamber 17*a*. The ventilation pipe 3*a* is arranged in the internal space of the shell 2*a* so as to be opened in the expansion chamber 17*a* by being inserted through an insertion hole 72*a* formed in the partition 7*a* and an insertion hole 83*a* formed in the partition 8*a*. The ventilation pipe 4*a* is arranged in the internal space of the shell 2*a* so as to be opened in the expansion chamber 12*a* by being inserted through an insertion hole 82*a* formed in the partition 8*a*.

Between the peripheral edge of the insertion hole 5*a* and the ventilation pipe 3*a*, a sound-absorbing fiber material filling gap 13*a* is provided so as to allow the filling nozzle 100 to be inserted therein to fill the sound-absorbing chamber 10*a* with the sound-absorbing fiber material 9*a*. The sound-absorbing fiber material filling gap 13*a* is closed by an annular closing member 14*a* arranged so as to cover the insertion hole 5*a*. As shown in FIG. 7 and FIG. 8, the annular closing member 14*a* is formed of metal material such as stainless steel, in the cap-like shape in which an inner cylinder part 142*a* rises from the inner edge of an annular base plate 141*a*, an outer cylinder part 143*a* rises from the outer edge of the base plate 141*a* to the opposite side of the inner cylinder part 142*a*, and an end-widened part 144*a* is formed at the tip part of the outer cylinder part 143*a* in a taper shape so as to be widened to the outside.

The inner cylinder part 142*a* of the annular closing member 14*a* is arranged along the outer circumference of the ventilation pipe 3*a*, and is firmly fixed to the ventilation pipe 3*a* by welding at a welding part W5 such as the tip part of the inner cylinder part 142*a*. The end-widened part 144*a* provided at the tip of the outer cylinder part 143*a* of the annular closing member 14*a* is arranged at the peripheral edge of the insertion hole 5*a* along the outer peripheral surface of the shell 2*a*, and is firmly fixed to the shell 2*a* by welding at a welding part W6 such as the tip part of the end-widened part 144*a*.

Figure 8A:
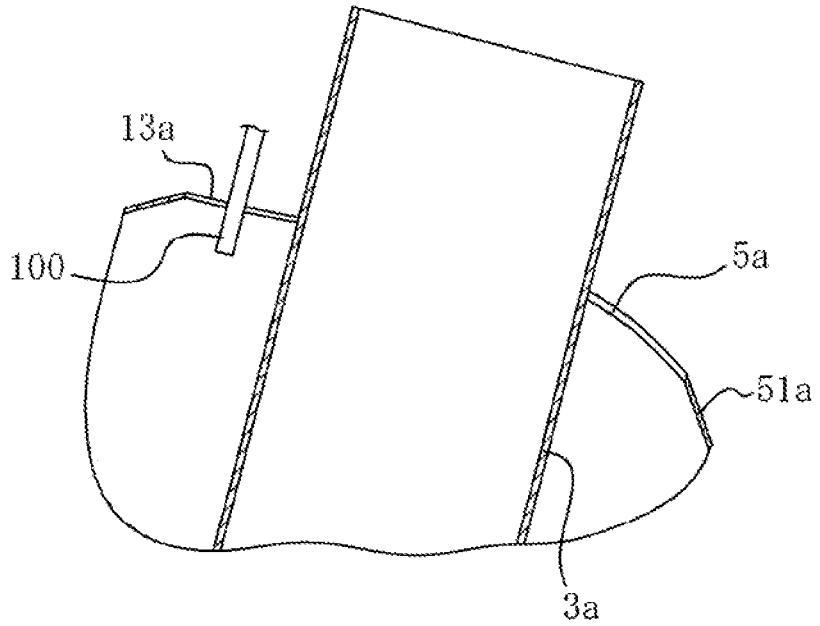
FIG. 8*a* is a partial cross-sectional explanatory drawing for describing filling with sound-absorbing fiber material through a sound-absorbing fiber material filling gap in the silencing apparatus of the second embodiment.

In the manufacturing of the silencing apparatus 1*a* of the second embodiment, as shown in FIG. 8*a*, a sound-absorbing corresponding chamber serving as the sound-absorbing chamber 10*a* is filled with the sound-absorbing fiber material 9*a* from the filling nozzle 100 inserted in the sound-absorbing fiber material filling gap 13*a* arranged between the insertion hole 5*a* and the ventilation pipe 3*a*. In the filling step, the filling with the sound-absorbing fiber material 9*a* is preferably implemented under the state where the adjacent expansion chamber 12*a* positioned adjacent to the sound-absorbing corresponding chamber via the partition 7*a* is made negative in pressure. In particular, the filling with the sound-absorbing fiber material 9*a* is more preferably implemented under the state where the adjacent expansion chamber 12*a* is made negative in pressure by air suction through the ventilation pipe 4*a*. It is noted that the filling with the sound-absorbing fiber material 9*a* may be implemented by sending air through the ventilation pipe 3*a*.

Figure 8B:
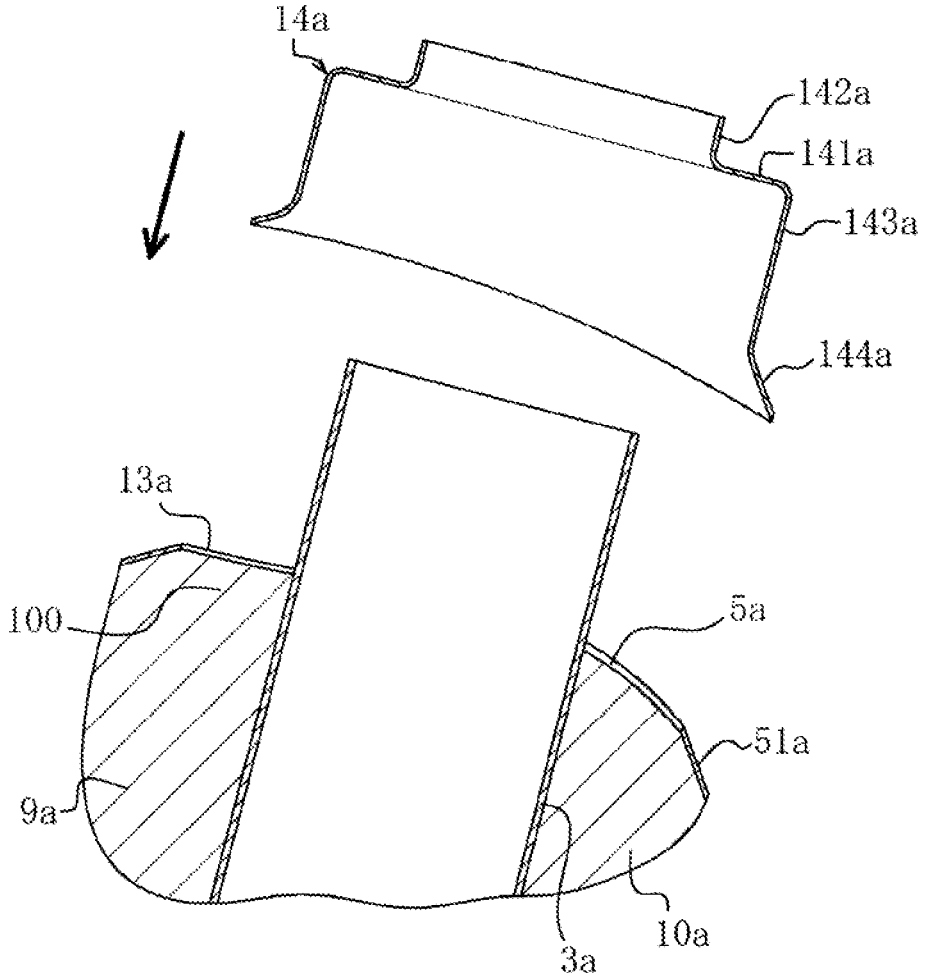
FIG. 8*b* is a partial cross-sectional explanatory drawing for describing closing of the sound-absorbing fiber material filling gap with the annular closing member.

As shown in FIG. 8*b* and FIG. 7, after the sound-absorbing chamber 10*a* is configured by the filling with the sound-absorbing fiber material 9*a*, the filling nozzle 100 is removed from the sound-absorbing fiber material filling gap 13*a*, and the annular closing member 14*a* is arranged so as to cover the sound-absorbing fiber material filling gap 13*a* (refer to the thick line arrow in FIG. 8*b*). The annular closing member 14*a* is then firmly fixed by welding at the welding parts W5, W6, whereby the sound-absorbing fiber material filling gap 13*a* is closed by the annular closing member 14*a*. In addition, a necessary step such as of firm fixing of the ventilation pipe 4*a* to the peripheral edge of the insertion hole 6*a* by welding or the like is implemented, whereby the silencing apparatus 1*a* is obtained.

The second embodiment enables to produce the effects corresponding to the first embodiment due to the corresponding configurations. The insertion hole 5*a* has a shape without any outward protrusion formed by burring or the like, and this enhances the flexibility of the shape and configuration of the usable filling nozzle 100 for use in the filling with the sound-absorbing fiber material 9*a*, improves the flexibility in the manufacturing steps, and improves the productivity. This further enhances the flexibility of the operation and enlarges the range in the operation of the filling nozzle 100 for use in the filling with the sound-absorbing fiber material 9*a*, thereby enabling to fill the sound-absorbing chamber 10*a* with the sound-absorbing fiber material 9*a* without a gap in a higher level.

Silencing Apparatus of Third Embodiment

Figure 9:
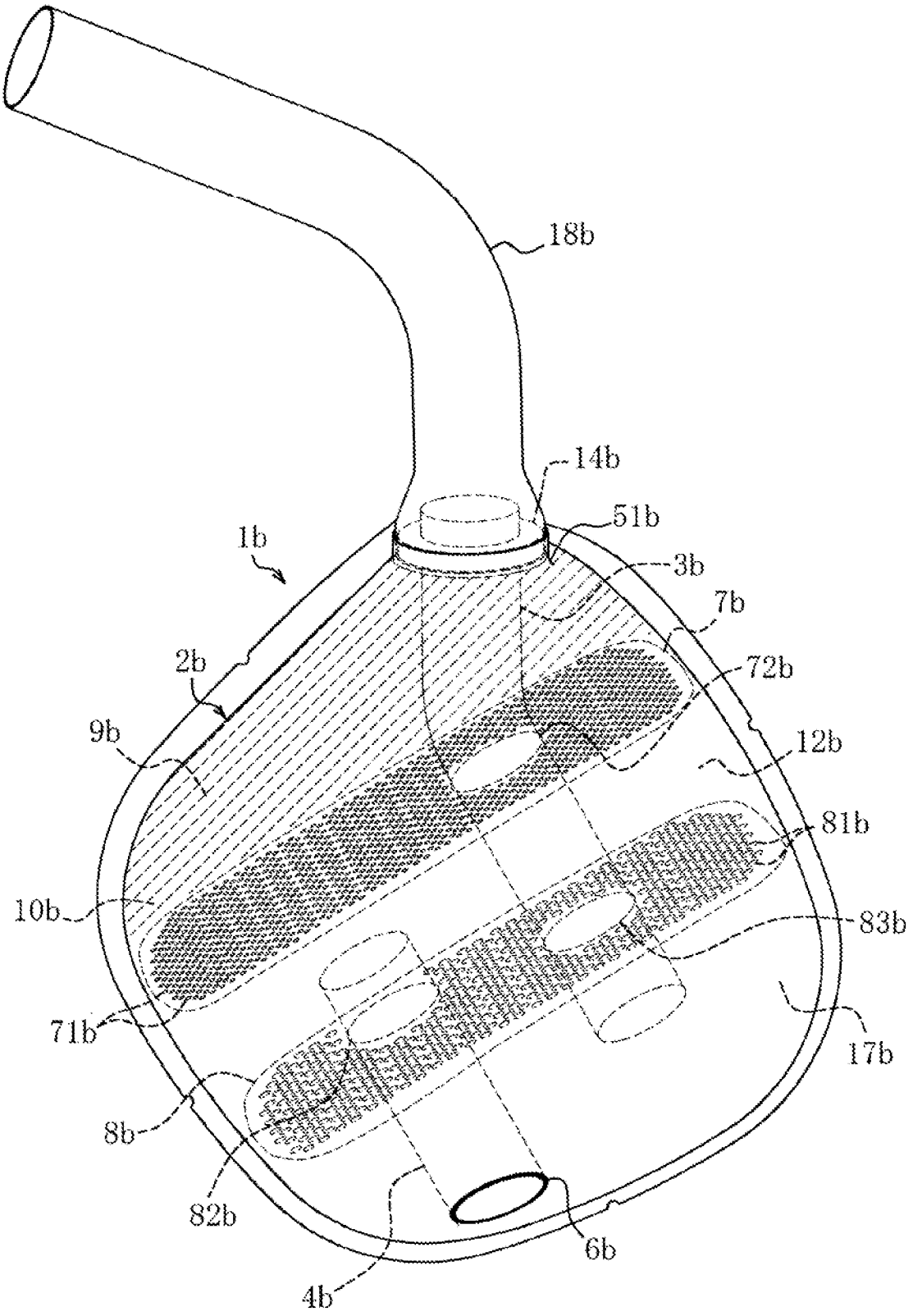
FIG. 9 is an oblique view illustrating a silencing apparatus of a third embodiment according to the present invention.
Figure 10:
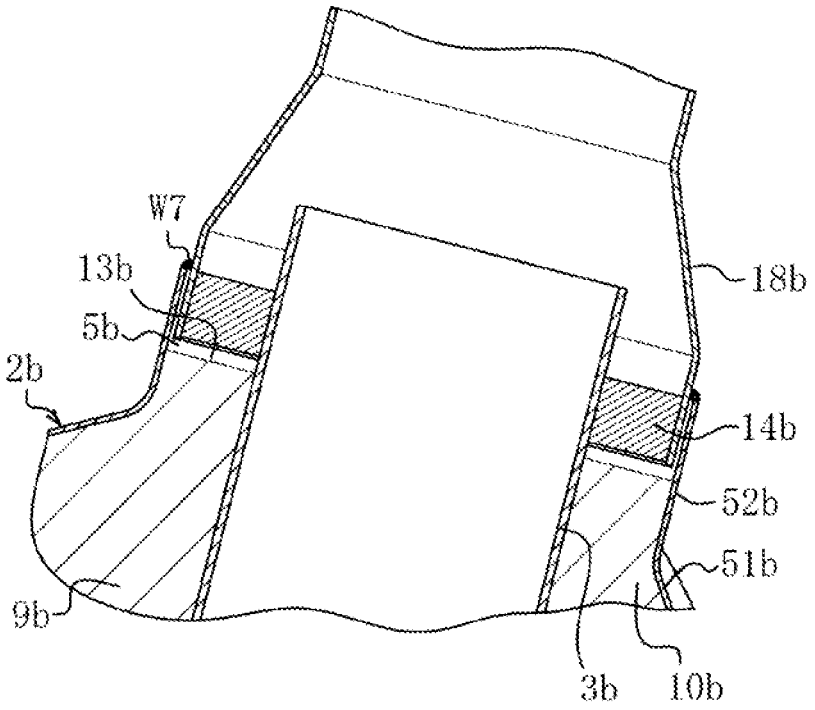
FIG. 10 is an enlarged cross-sectional view of a peripheral part of an annular closing member in the silencing apparatus of the third embodiment.

A silencing apparatus 1*b* of the third embodiment according to the present invention is also configured to be installed in an exhaust path of an automobile, and includes, as shown in FIG. 9 to FIG. 11, a metal shell 2*b* formed substantially in a shell shape, ventilation pipes 3*b*, 4*b* which respectively communicate with the inside of the shell 2*b* substantially at opposite positions of the shell 2*b*, an insertion hole 5*b* in which the ventilation pipe 3*b* is inserted loosely, an insertion hole 6*b* in which the ventilation pipe 4*b* is inserted, and partitions 7*b*, 8*b* which partition the inside of the shell 2*b*.

Each of the ventilation pipes 3*b*, 4*b* is included in an exhaust pipe. The illustrated ventilation pipe 3*b* serves as an exhaust inlet pipe, and the ventilation pipe 4*b* serves as an exhaust outlet pipe. The insertion holes 5*b*, 6*b* in which the ventilation pipes 3*b*, 4*b* are loosely inserted are the through holes formed in the shell 2*b* so as to have sizes larger than the diameters of the ventilation pipes 3*b*, 4*b*, respectively. The insertion hole 5*b* is formed so as to have a size allowing the ventilation pipe 3*b* to be loosely inserted in, and the insertion hole 6*b* is formed so as to have a size allowing the ventilation pipe 4*b* to fit in. The ventilation pipe 4*b* is firmly fixed to the peripheral edge of the insertion hole 6*b* by welding or the like. The insertion hole 5*b* is formed so as to have a size smaller than a surrounding skirt part Mb configured with the shell 2*b*, and further so as to be opened at the tip part of a rising part 52*b* formed by burring or the like.

The partitions 7*b*, 8*b* are respectively formed in flat-plate shapes. The flat-plate-shape partitions 7*b*, 8*b* respectively have communication holes 71*b*, 81*b* which have the same configurations as the communication holes 71, 81 of the first embodiment. The internal space of the shell 2*b* which is partitioned by the partition 7*b* and is positioned adjacent to the insertion hole 5*b* serves as a sound-absorbing chamber 10*b*. The sound-absorbing chamber 10*b* is filled with a sound-absorbing fiber material 9*b* which has the same configuration as the sound-absorbing fiber material 9 of the first embodiment.

The internal space of the shell 2*b* between the partition 7*b* and the partition 8*b* serves as an expansion chamber 12*b*. In addition, the internal space of the shell 2*b* which is partitioned by the partition 8*b* and is positioned adjacent to the insertion hole 6*b* serves as an expansion chamber 17*b*. The ventilation pipe 3*b* is arranged, as with the ventilation pipe 3*a* of the second embodiment, in the internal space of the shell 2*b* so as to be opened in the expansion chamber 17*b* by being inserted through an insertion hole 72*b* formed in the partition 7*b* and an insertion hole 83*b* formed in the partition 8*b*. The ventilation pipe 4*b* is arranged in the internal space of the shell 2*b* so as to be opened in the expansion chamber 12*b* by being inserted through an insertion hole 82*b* formed in the partition 8*b*.

Between the peripheral edge of the insertion hole 5*b* and the ventilation pipe 3*b*, a sound-absorbing fiber material filling gap 13*b* is provided so as to allow the filling nozzle 100 to be inserted therein to fill the sound-absorbing chamber 10*b* with the sound-absorbing fiber material 9*b*. A connection pipe 18*b* to be connected to the ventilation pipe 3*b* is internally fitted to the peripheral edge of the insertion hole 5*b*, specifically in the present embodiment the connection pipe 18*b* is internally fitted to the rising part 52*b* of the insertion hole 5*b*, and an annular closing member 14*b* which is formed of metal mesh or the like and is fitted in the inner circumference of the connection pipe 18*b* is externally fitted to the ventilation pipe 3*b*. The sound-absorbing fiber material filling gap 13*b* is closed by the annular closing member 14*b* due to the internal fitting and the external fitting. The shell 2*b* and the connection pipe 18*b* are firmly fixed to each other at a welding part W7 such as the tip part of the rising part 52*b*.

Figure 11A:
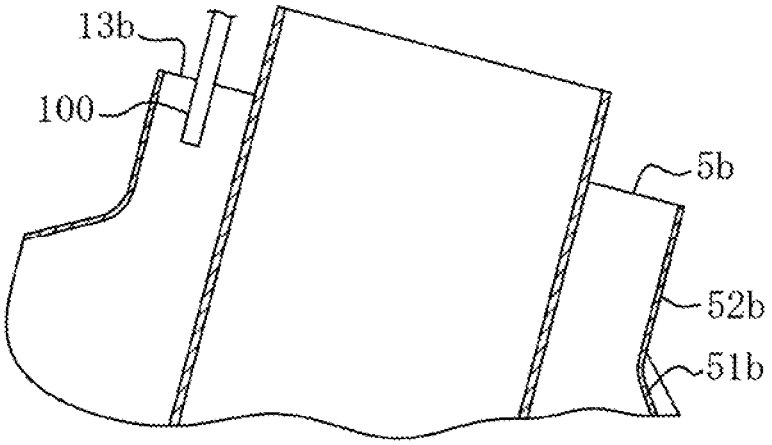
FIG. 11*a* is a partial cross-sectional explanatory drawing for describing filling with sound-absorbing fiber material through a sound-absorbing fiber material filling gap in the silencing apparatus of the third embodiment.
Figure 11B:
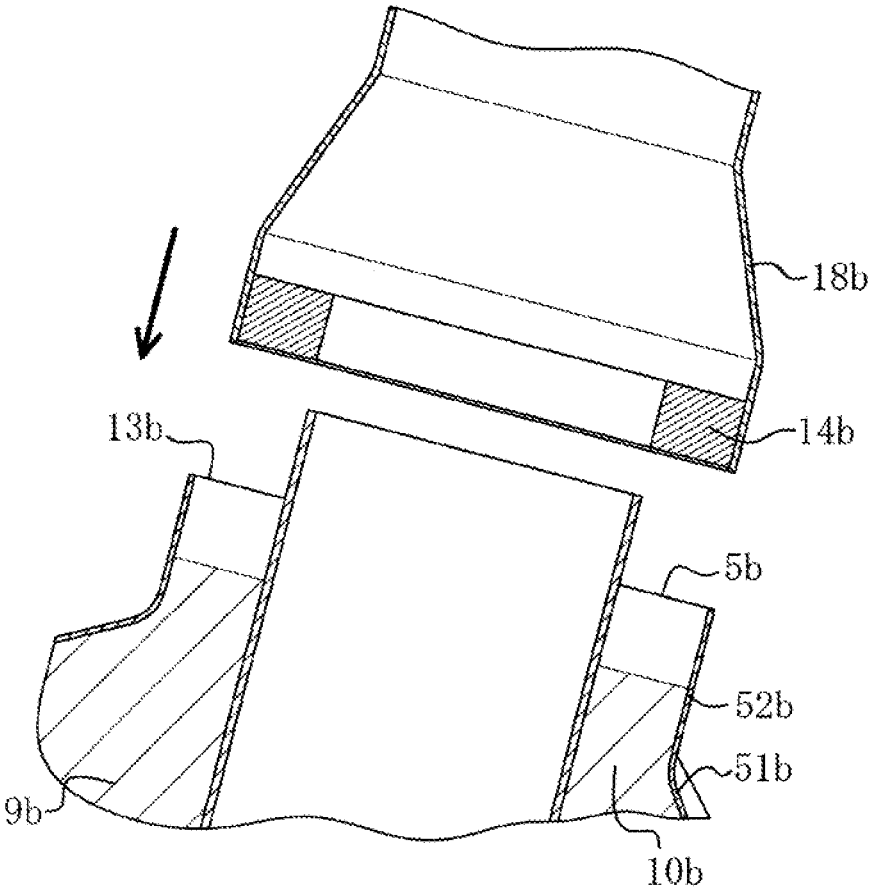
FIG. 11*b* is a partial cross-sectional explanatory drawing for describing closing of the sound-absorbing fiber material filling gap with the annular closing member.

In the manufacturing of the silencing apparatus 1*b* of the third embodiment, as shown in FIG. 11*a*, a sound-absorbing corresponding chamber serving as the sound-absorbing chamber 10*b* is filled with the sound-absorbing fiber material 9*b* from the filling nozzle 100 inserted in the sound-absorbing fiber material filling gap 13*b* arranged between the insertion hole 5*b* and the ventilation pipe 3*b*. In the filling step, the filling with the sound-absorbing fiber material 9*b* is preferably implemented under the state where the adjacent expansion chamber 12*b* positioned adjacent to the sound-absorbing corresponding chamber via the partition 7*b* is made negative in pressure. In particular, the filling with the sound-absorbing fiber material 9*b* is more preferably implemented under the state where the adjacent expansion chamber 12*b* is made negative in pressure by air suction through the ventilation pipe 4*b*. It is noted that the filling with the sound-absorbing fiber material 9*b* may be implemented by sending air through the ventilation pipe 3*b*.

As shown in FIG. 11*b* and FIG. 10, after the sound-absorbing chamber 10*b* is configured by the filling with the sound-absorbing fiber material 9*b*, the filling nozzle 100 is removed from the sound-absorbing fiber material filling gap 13*b*, and the internal fitting in terms of the connection pipe 18*b* and the external fitting in terms of the annular closing member 14*b* fitted in the inner circumference of the connection pipe 18*b* to the ventilation pipe 3*b* are implemented as described above (refer to the thick line arrow in FIG. 11*b*). The annular closing member 14*b* is then firmly fixed by welding at the welding part W7, whereby the sound-absorbing fiber material filling gap 13*b* is closed by the annular closing member 14*b*. In addition, a necessary step such as of firm fixing of the ventilation pipe 4*b* to the peripheral edge of the insertion hole 6*b* by welding or the like is implemented, whereby the silencing apparatus 1*b* is obtained.

The third embodiment enables to produce the effects corresponding to first embodiment due to the corresponding configurations. The usage of the annular closing member 14*b* fitted in the inner circumference of the connection pipe 18*b* for closing the sound-absorbing fiber material filling gap 13*b* eliminates the needs of preparing and fixing an extra annular closing member in addition to the connection pipe 18*b*. Thus, this reduces the component costs and the manufacturing costs, and reduces the manufacturing steps.

Scope of Invention Disclosed Herein

The invention disclosed herein includes not only the respective aspects described as the invention and the respective embodiments, but also, within the applicable range, the aspect specified by changing some contents disclosed herein to other contents disclosed herein, the aspect specified by adding other contents disclosed herein to the contents disclosed herein, and the aspect specified by deleting some contents disclosed herein to the limit allowing to produce partial effects so as to make generic concept. The invention disclosed herein includes the modifications and additions to be described below.

In an example, although the silencing apparatuses 1*a*, 1*b* of the second and third embodiments are provided with the expansion chambers 17*a*, 17*b*, respectively, the present invention further includes a silencing apparatus in which a chamber corresponding to the expansion chamber 17*a* or 17*b* is filled with the sound-absorbing fiber material 9*a* or 9*b* as with the sound-absorbing chamber 11 of the first embodiment, and serves as a sound-absorbing chamber. The number of the sound-absorbing chambers and the number of the expansion chambers in the silencing apparatus according to the present invention may be appropriately set as necessary within the scope of the purport of the present invention.

In the present invention, any type of partition is available as long as the partition is able to partition the inside of the shell. In the case of a plate-shape partition in the present invention, the partition may have not only a flat-plate shape as with the partitions 7, 7*a*, 7*b* and the partitions 8, 8*a*, 8*b* in the embodiments described above, but also an appropriate plate shape, for example, a curved plate shape, an undulated plate shape, a corrugated plate shape, or a dome shape.

INDUSTRIAL USABILITY

The present invention is applicable to a silencing apparatus to be installed in, for example, an exhaust path of an internal combustion engine for an automotive.

REFERENCE SIGNS LIST

1, 1*m*, 1*a*, 1*b*: SILENCING APPARATUS
2, 2*a*, 2*b*: SHELL
3, 3*a*, 3*b*: VENTILATION PIPE
4, 4*a*, 4*b*: VENTILATION PIPE
5, 5*a*, 5*b*: INSERTION HOLE
51, 51*a*, 51*b*: SKIRT PART
52, 52*b*: RISING PART
6, 6*a*, 6*b*: INSERTION HOLE
61: SKIRT PART
62: RISING PART

7, 7*a*, 7*b*: PARTITION
71, 71*a*, 71*b*: COMMUNICATION HOLE
72, 72*a*, 72*b*: INSERTION HOLE
8, 8*a*, 8*b*: PARTITION
81, 81*a*, 81*b*: COMMUNICATION HOLE
82, 82*a*, 82*b*: INSERTION HOLE
83*a*, 83*b*: INSERTION HOLE
9, 9*a*, 9*b*: SOUND-ABSORBING FIBER MATERIAL
10, 10*a*, 10*b*: SOUND-ABSORBING CHAMBER
11: SOUND-ABSORBING CHAMBER
12, 12*a*, 12*b*: EXPANSION CHAMBER
13, 13*a*, 13*b*: SOUND-ABSORBING FIBER MATERIAL FILLING GAP
14, 14*a*, 14*b*: ANNULAR CLOSING MEMBER
141, 141*a*: BASE PLATE
142, 142*a*: INNER CYLINDER PART
143, 143*a*: OUTER CYLINDER PART
144*a*: END-WIDENED PART
15: SOUND-ABSORBING FIBER MATERIAL FILLING GAP
16: ANNULAR CLOSING MEMBER
161: BASE PLATE
162: INNER CYLINDER PART
163: OUTER CYLINDER PART
17*m*, 17*a*, 17*b*: EXPANSION CHAMBER
18*b*: CONNECTION PIPE
W1, W2, W3, W4, W5, W6, W7: WELDING PART
100: FILLING NOZZLE

The invention claimed is:

1. A silencing apparatus comprising:
a shell;
a first annular closing member;
a first ventilation pipe communicating with an inside of the shell;
a first insertion hole formed in the shell so as to have a size smaller than a surrounding skirt part, the first insertion hole allowing the first ventilation pipe to be loosely inserted in; and
a first partition partitioning the inside of the shell, wherein
the first annular closing member includes an annular base plate, an inner cylinder part, and an outer cylinder part,
the first annular closing member has a cap-like shape in which the inner cylinder part rises from an inner edge of the annular base plate, and the outer cylinder part rises from an outer edge of the annular base plate, extending towards an opposite side of the inner cylinder part,
the inner cylinder part is arranged along an outer circumference of the first ventilation pipe and is fixed to the first ventilation pipe, and the outer cylinder part is arranged along an outer circumference of the shell and is fixed to the shell,
a first sound-absorbing chamber partitioned by the first partition and positioned adjacent to the first insertion hole is filled with a sound-absorbing fiber material, and
a first sound-absorbing fiber material filling gap between a peripheral edge of the first insertion hole and the first ventilation pipe is closed by the first annular closing member.

2. The silencing apparatus according to claim 1, the silencing apparatus further comprising:
a second ventilation pipe communicating with the inside of the shell; and
a second insertion hole formed in the shell so as to have a size smaller than a surrounding skirt part, the second insertion hole allowing the second ventilation pipe to be loosely inserted in.

3. The silencing apparatus according to claim 2, wherein a second sound-absorbing chamber partitioned by a second partition and positioned adjacent to the second insertion hole is filled with the sound-absorbing fiber material, and a second sound-absorbing fiber material filling gap between a peripheral edge of the second insertion hole and the second ventilation pipe is closed by a second annular closing member.

4. The silencing apparatus according to claim 1, wherein
the first partition is formed in a plate shape, and
the first partition has a large number of communication holes not allowing the sound-absorbing fiber material to pass through, substantially over a whole surface.

5. The silencing apparatus according to claim 2, wherein
the second partition is formed in a plate shape, and
the second partition has a large number of communication holes not allowing the sound-absorbing fiber material to pass through, substantially over a whole surface.

6. The silencing apparatus according to claim 1, wherein the first insertion hole is formed in a shape with an outward protrusion of the shell, the outer cylinder part of the annular closing member is arranged along an outer circumference of the outward protrusion and is fixed to the outward protrusion.

7. The silencing apparatus according to claim 1, wherein
the first insertion hole is formed in a shape without any outward protrusion, and
the first annular closing member is arranged so as to cover the first insertion hole.

8. The silencing apparatus according to claim 7, wherein the first annular closing member further includes an end-widened part formed at a tip part of the outer cylinder part in a taper shape so as to be widened to outside, and the end-widened part is arranged at the peripheral edge of the first insertion hole along an outer peripheral surface of the shell, and is fixed to the shell.

9. The silencing apparatus according to claim 3, wherein
the second insertion hole is formed in a shape without any outward protrusion, and
the second annular closing member is arranged so as to cover the second insertion hole.

10. The silencing apparatus according to claim 1, wherein
a first connection pipe to be connected to the first ventilation pipe is internally fitted to the peripheral edge of the first insertion hole, and
the first annular closing member fitted in an inner circumference of the first connection pipe is externally fitted to the first ventilation pipe.

11. The silencing apparatus according to claim 3, wherein
a second connection pipe to be connected to the second ventilation pipe is internally fitted to the peripheral edge of the second insertion hole, and
the second annular closing member fitted in an inner circumference of the second connection pipe is externally fitted to the second ventilation pipe.

12. A method for manufacturing a silencing apparatus, the silencing apparatus comprising:
a shell;
a first annular closing member;
a first ventilation pipe communicating with an inside of the shell;
a first insertion hole formed in the shell so as to have a size smaller than a surrounding skirt part, the first insertion hole allowing the first ventilation pipe to be loosely inserted in; and
a first partition partitioning the inside of the shell, wherein the first annular closing member includes an annular base plate, an inner cylinder part, and an outer cylinder part, the first annular closing member has a cap-like shape in which the inner cylinder part rises from an inner edge of the annular base plate, and the outer cylinder part rises from an outer edge of the annular base plate, extending towards an opposite side of the inner cylinder part, the inner cylinder part is arranged along an outer circumference of the first ventilation pipe and is fixed to the first ventilation pipe, and the outer cylinder part is arranged along an outer circumference of the shell and is fixed to the shell, a first sound-absorbing chamber partitioned by the first partition and positioned adjacent to the first insertion hole is filled with a sound-absorbing fiber material, and a first sound-absorbing fiber material filling gap between a peripheral edge of the first insertion hole and the first ventilation pipe is closed by the first annular closing member; and the method comprising:

filling the first sound-absorbing chamber with the sound-absorbing fiber material from a first filling nozzle inserted in the first sound-absorbing fiber material filling gap, wherein an first adjacent chamber is positioned adjacent to the first sound-absorbing chamber and is made negative in pressure; and closing the first sound-absorbing fiber material filling gap with the first annular closing member after the filling with the sound-absorbing fiber material.

13. The method according to claim 12, the silencing apparatus further comprising:

a second insertion hole formed in the shell so as to have a size smaller than a surrounding skirt part, the second insertion hole allowing the second ventilation pipe to be loosely inserted in, a second sound-absorbing chamber partitioned by a second partition and positioned adjacent to the second insertion hole is filled with the sound-absorbing fiber material, and a second sound-absorbing fiber material filling gap between a peripheral edge of the second insertion hole and the second ventilation pipe is closed by a second annular closing member; and the method further comprising:

filling the second sound-absorbing chamber with the sound-absorbing fiber material from a second filling nozzle inserted in the second sound-absorbing fiber material filling gap, wherein a second adjacent chamber is positioned adjacent to the second sound-absorbing chamber and is made negative in pressure; and closing the second sound-absorbing fiber material filling gap with the second annular closing member after the filling with the sound-absorbing fiber material.

* * * * *